US010154732B2

(12) United States Patent
O'Neill

(10) Patent No.: US 10,154,732 B2
(45) Date of Patent: Dec. 18, 2018

(54) PORTABLE SURFACE FOR LOUNGING OR SLEEPING

(71) Applicant: Brendan O'Neill, Guilderland, NY (US)

(72) Inventor: Brendan O'Neill, Guilderland, NY (US)

( * ) Notice: Subject to any disclaimer, the term of this patent is extended or adjusted under 35 U.S.C. 154(b) by 71 days.

(21) Appl. No.: 15/382,218

(22) Filed: Dec. 16, 2016

(65) Prior Publication Data

US 2018/0168354 A1 Jun. 21, 2018

(51) Int. Cl.

| | |
|---|---|
| ***A47C 1/14*** | (2006.01) |
| ***A47C 4/00*** | (2006.01) |
| ***A47C 4/52*** | (2006.01) |
| ***A47C 7/02*** | (2006.01) |
| ***A47C 17/70*** | (2006.01) |
| ***A47C 17/78*** | (2006.01) |
| ***A47C 17/82*** | (2006.01) |

(52) U.S. Cl.

CPC ..... *A47C 1/143* (2013.01); *A47C 1/146* (2013.01); *A47C 4/52* (2013.01); *A47C 7/021* (2013.01); *A47C 17/70* (2013.01); *A47C 17/78* (2013.01); *A47C 17/82* (2013.01)

(58) Field of Classification Search

None

See application file for complete search history.

(56) References Cited

U.S. PATENT DOCUMENTS

| | | | | | |
|---|---|---|---|---|---|
| 2,244,605 | A * | 6/1941 | Benoit | A47C 5/005 | 297/381 |
| D167,514 | S * | 8/1952 | Hicks | 297/17 | |
| 2,834,032 | A * | 5/1958 | Scott | A47C 20/021 | 297/377 |
| 3,121,884 | A * | 2/1964 | Emery | A47C 1/146 | 248/455 |
| 3,604,751 | A * | 9/1971 | Caigan | A47C 5/005 | 229/800 |
| 3,606,459 | A * | 9/1971 | Krone | A47C 5/005 | 297/440.12 |
| 3,627,086 | A * | 12/1971 | Caigan | A47C 1/146 | 190/8 |
| 3,695,703 | A * | 10/1972 | Notko | A47C 5/005 | 297/440.12 |
| 3,717,377 | A * | 2/1973 | Johnson | A47C 5/005 | 297/440.12 |
| 3,947,903 | A * | 4/1976 | Menke | A47C 1/14 | 5/111 |
| 4,032,099 | A * | 6/1977 | Maude | A47C 1/029 | 248/188.2 |
| 4,470,630 | A * | 9/1984 | Shields | A47C 1/14 | 297/118 |
| 4,530,451 | A * | 7/1985 | Hamilton | A45F 4/02 | 224/153 |

(Continued)

*Primary Examiner* — James M Ference
*Assistant Examiner* — Kyle J. Walraed-Sullivan

(57) ABSTRACT

A portable surface for lounging or sleeping with an elevated leg rest and backrest, and a seat that rests on the ground or other supporting surface such as a car seat, truck bed or bleacher. The various parts of the chair can be folded up and nest inside of each other in a compact bundle that may fit in a backpack or a map pocket for easy portability. When folded up, a strap can be tightened around the apparatus preventing the innards from unfolding, creating a smaller profile.

7 Claims, 5 Drawing Sheets

(56) References Cited

U.S. PATENT DOCUMENTS 4,773,708 A * 9/1988 Nastu ..... A47C 1/143 297/17
4,869,553 A * 9/1989 Powell ..... A47C 1/146 297/377
4,875,737 A * 10/1989 Cardenas ..... A47C 5/005 297/440.12
4,877,288 A * 10/1989 Lee ..... A47C 1/143 297/229
4,892,353 A * 1/1990 Goddard ..... A47C 1/14 297/188.2
4,894,877 A * 1/1990 Marsh ..... A47C 1/143 297/338
4,921,301 A * 5/1990 Haynes ..... A47C 1/143 297/118
4,926,512 A * 5/1990 Coyle ..... A47C 1/143 297/377
5,042,874 A * 8/1991 Williams ..... A47C 1/143 297/17
5,121,961 A * 6/1992 Marshall ..... A47C 1/143 297/17
5,322,342 A * 6/1994 Gange ..... A47C 1/14 239/289
5,582,458 A * 12/1996 Wildt ..... A47C 1/143 297/183.5
5,588,570 A * 12/1996 Zirbel ..... A45F 4/02 224/155
5,620,229 A * 4/1997 Ledford ..... A47C 1/143 297/183.5
5,624,157 A * 4/1997 Kostuk ..... A47C 1/143 297/218.1
5,823,617 A * 10/1998 Schafer ..... A47C 1/14 297/180.15
5,944,384 A * 8/1999 Patterson ..... A47C 1/14 297/115
5,947,561 A * 9/1999 Ryan ..... A47C 1/143 297/183.5
5,950,259 A * 9/1999 Boggs ..... A47C 1/143 297/900
6,059,365 A * 5/2000 Diamond ..... A47C 1/026 297/354.13
6,113,181 A * 9/2000 Tang ..... A47C 1/143 297/188.04
6,176,549 B1 * 1/2001 Karash ..... A47C 7/383 229/190
6,213,555 B1 * 4/2001 Sulpizio ..... A47C 1/143 108/116
6,244,481 B1 * 6/2001 Brougher ..... A45F 4/02 224/153
6,250,712 B1 * 6/2001 Livington ..... A47C 1/146 297/129
D450,970 S * 11/2001 Self ..... A47C 1/14 D6/611
6,626,491 B1 * 9/2003 Blome ..... A45F 4/08 297/188.2
7,959,222 B1 * 6/2011 Powell ..... A47C 20/026 297/188.06
8,668,268 B1 * 3/2014 Cormack ..... A47C 1/026 297/354.13
8,708,406 B1 * 4/2014 Powell ..... A47C 21/00 297/188.06
9,808,087 B1 * 11/2017 Ghazal ..... A47C 1/14
2001/0035672 A1 * 11/2001 Graff ..... A47C 1/14 297/229
2002/0016993 A1 * 2/2002 Nation ..... A47C 1/143 5/110
2002/0063455 A1 * 5/2002 Self ..... A47C 1/14 297/229
2002/0095723 A1 * 7/2002 Nation ..... A47C 1/143 5/110
2005/0262641 A1 * 12/2005 Maslyar ..... A47C 1/14 5/725
2005/0264049 A1 * 12/2005 Fleites ..... A47C 1/143 297/188.04
2006/0082198 A1 * 4/2006 Mafrice ..... A47C 1/146 297/217.4
2007/0145792 A1 * 6/2007 Miller ..... A47C 1/0265 297/184.1
2007/0210628 A1 * 9/2007 Arnold ..... A47C 1/143 297/229
2007/0236057 A1 * 10/2007 Smith ..... A47C 1/143 297/183.2
2009/0322129 A1 * 12/2009 Rodill ..... A47C 1/14 297/229
2010/0045080 A1 * 2/2010 Haugan ..... A47C 1/146 297/183.5
2010/0201162 A1 * 8/2010 Leywood ..... A47C 5/005 297/16.1
2011/0193372 A1 * 8/2011 Pizzuto ..... A47C 1/143 297/16.1
2012/0205951 A1 * 8/2012 Strolka-Echols .... A47C 20/041 297/217.3
2014/0183909 A1 * 7/2014 Smith ..... A47C 20/026 297/115
2015/0091336 A1 * 4/2015 Loney ..... A47C 1/146 297/16.2
2015/0230609 A1 * 8/2015 Klaseen ..... A47C 1/143 297/111
2018/0027975 A1 * 2/2018 Miller ..... A47C 1/146
2018/0035792 A1 * 2/2018 Martinez ..... A45F 3/26

* cited by examiner

PORTABLE SURFACE FOR LOUNGING OR SLEEPING

CROSS-REFERENCE TO RELATED APPLICATIONS

This application claims the benefit of provisional patent application No. 62/294,081, filed 2016 Feb. 11 by the present inventor.

BACKGROUND

Prior Art

The following is a tabulation of some prior art that presently appears relevant:

| U.S. Patents | | |
|---|---|---|
| Pat. No. | Issue Date | Patentee |
| 2,834,032 | May 13, 1958 | Scott |
| 5,121,961 | Jun. 16, 1992 | Mashall |
| d167514 | Aug. 19, 1952 | Hicks |
| 6,250,712 | Jun. 26, 2001 | Livington, et al. |

Many people carry folding chairs to the beach, parks, and other outdoor destinations. Typically, the folding chair is a simple small chair. However, some people would prefer the comfort of a larger lounge-style chair that provides support to the legs. Although many lounge chair designs exist, most are too large and too bulky to be comfortably carried for any significant period of time. Accordingly, lounge-style chairs are rarely transported farther than from the house to the backyard patio, or from the car to the beach. In the prior art, there are many lounge chairs that fold into smaller sizes. Such lounge chairs are exemplified by U.S. Pat. No. 2,834,032 to Scott, entitled Body Support. Although such prior art lounge chairs can be folded to some degree, the lounge chairs remain bulky and difficult to transport because they call for a frame, or some other form of adaptation on the base/seat portion of the chair to keep the seat off the ground.

SUMMARY

In general, the present embodiment provides a leg rest, a backrest and a seat which directly contacts the ground without adaptation. This novel arrangement retains comfort without necessitating a frame, legs, or any other type of adaptation to the seat. One embodiment of a portable surface for lounging or sleeping includes a seat, a backrest, a back support assembly and a leg support assembly. The seat rests on the ground. The angle of the backrest can be adjusted by sliding it up or down the back support assembly and leaning back on it. The thighs can rest in an elevated position on a leg support assembly that is held in place by a strap laced through folded sheets of material and joined by a buckle that can be adjusted or buckled to secure the leg support assembly. The various parts of the device can nest inside of each other and fold up into a compact bundle that can fit in a backpack for easy portability. When folded up, the strap can be tightened at the buckle preventing the innards from unfolding and becoming cumbersome to carry.

ADVANTAGES

It is an object of the present embodiment to reduce the weight, bulk and cost of devices for lounging by forgoing any adaptation on the seat portion, allowing the material of the seat to directly contact the ground (or other supporting surface) when in use. The absence of a rigid metal frame makes it possible to improve on previous designs that fold in only 2 places-between the leg rest and seat, and between the seat and back rest. By folding at 3 or more places the present embodiment can fold to a smaller size for easier storage. By employing a base that is not adapted, but placed directly on the ground, the present embodiment can be constructed more cost efficiently, with less bulk and weight. Supporting the occupant's thighs at an elevated angle, relieves tension at the joints by allowing the legs to bend. This orientation of the legs obviates the need for a seat that is in any way adapted to rest off of the ground and makes for a more comfortable lounging position. Other advantages of one or more aspects will be apparent from consideration of the drawings and ensuing description.

DRAWINGS

Figures

DRAWINGS

Reference Numerals

20 Lower Backrest Segment Support Assembly
20-2 First Lower Backrest Segment Support Member
20-4 Second Lower Backrest Segment Support Member
20-6 Segment
20-8 String
20-10 Fold
20-12 Fold
22 Fold
24 Backrest
24-2 Upper Backrest Segment Support Member
24-4 Segment
24-6 Upper Backrest Segment
24-10 Fold
24-12 Fold
26 Fold
28 Lower Backrest Segment
30 Fold
32 Seat
34 Segment
34-2 Fold
34-4 Fold
36 Leg Support Assembly
36-2 Segment
36-4 Segment
36-6 First Leg Rest Support Member
36-8 Second Leg Rest Support Member

36-10 Fold
36-12 Fold
36-14 Fold
36-16 Left Side-Release Buckle Half
36-18 Right Side-Release Buckle Half
36-20 Left Slit in Segment 36-2
36-22 Left Slit in Segment 36-6
36-24 Right Slit in Segment 36-6
36-26 Right Slit in Segment 36-2
36-28 Strap
50 Backrest frame
52 Backrest Support
54 First Pin
56 Second Pin

DETAILED DESCRIPTION

Figure 1:
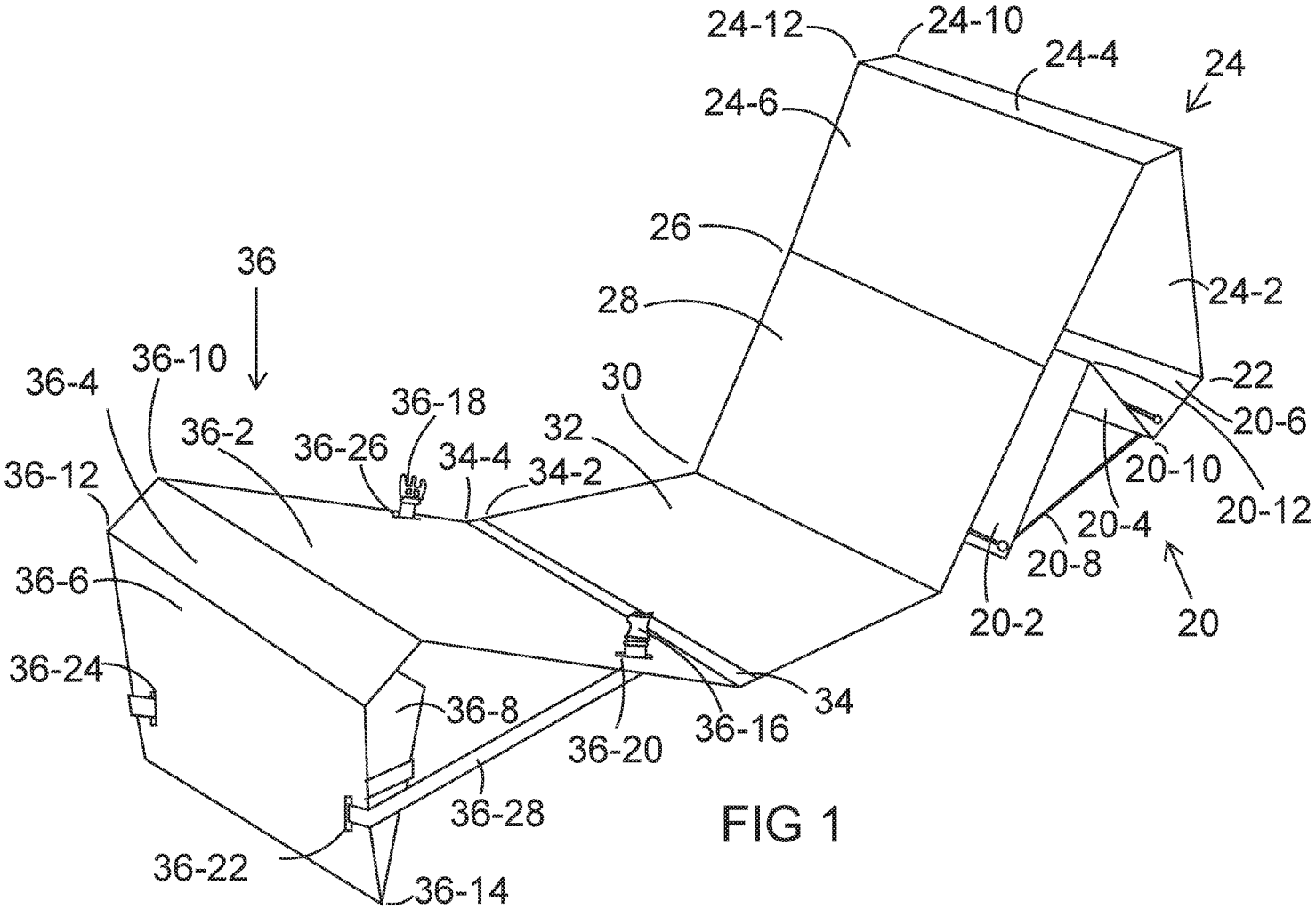
FIG. 1 is a side perspective view of a completed representation of one embodiment of the portable surface for lounging or sleeping.
Figure 2:
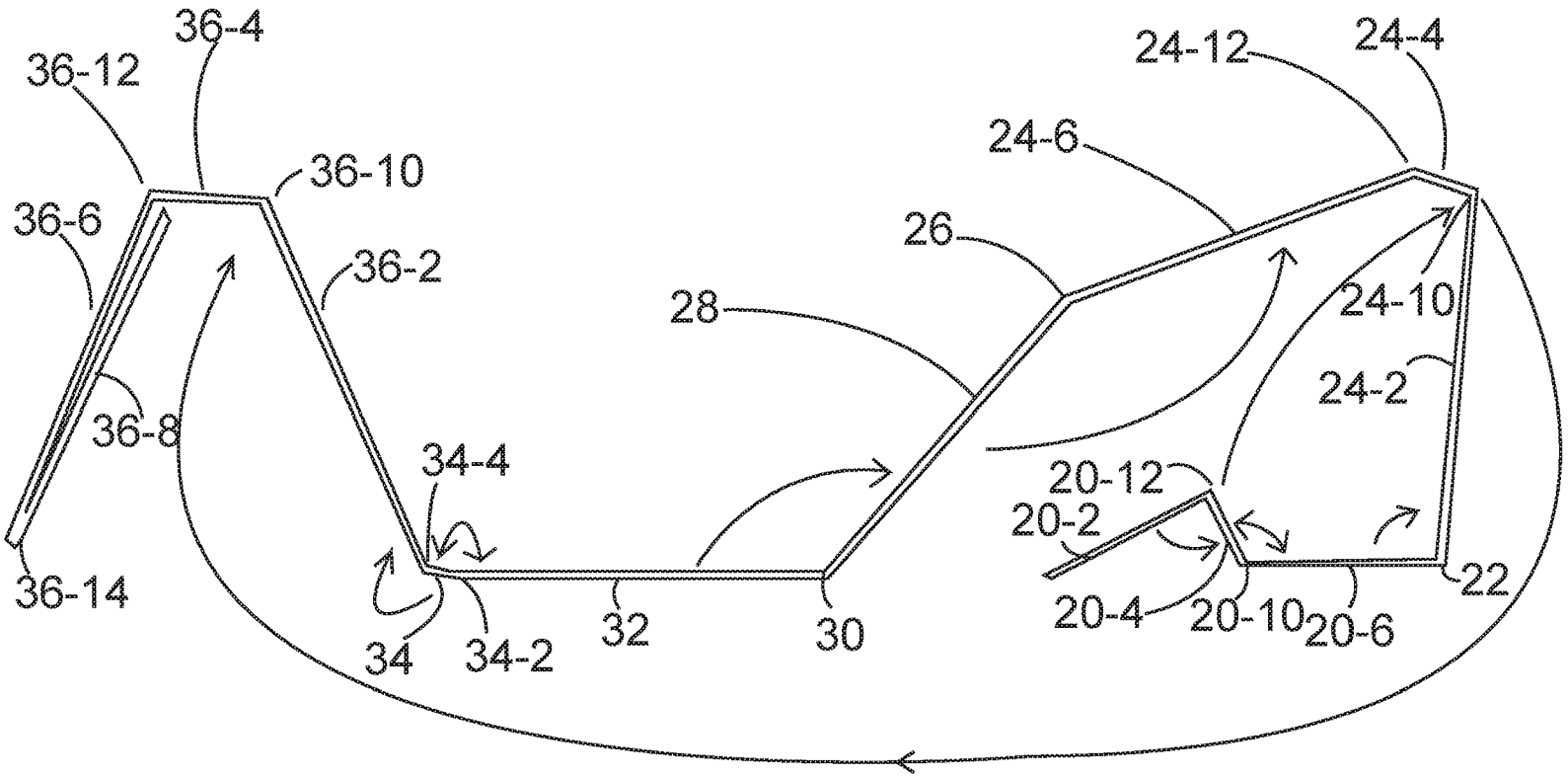
FIG. 2 is a side schematic view showing the paths of the various components when they fold up.
Figure 3:
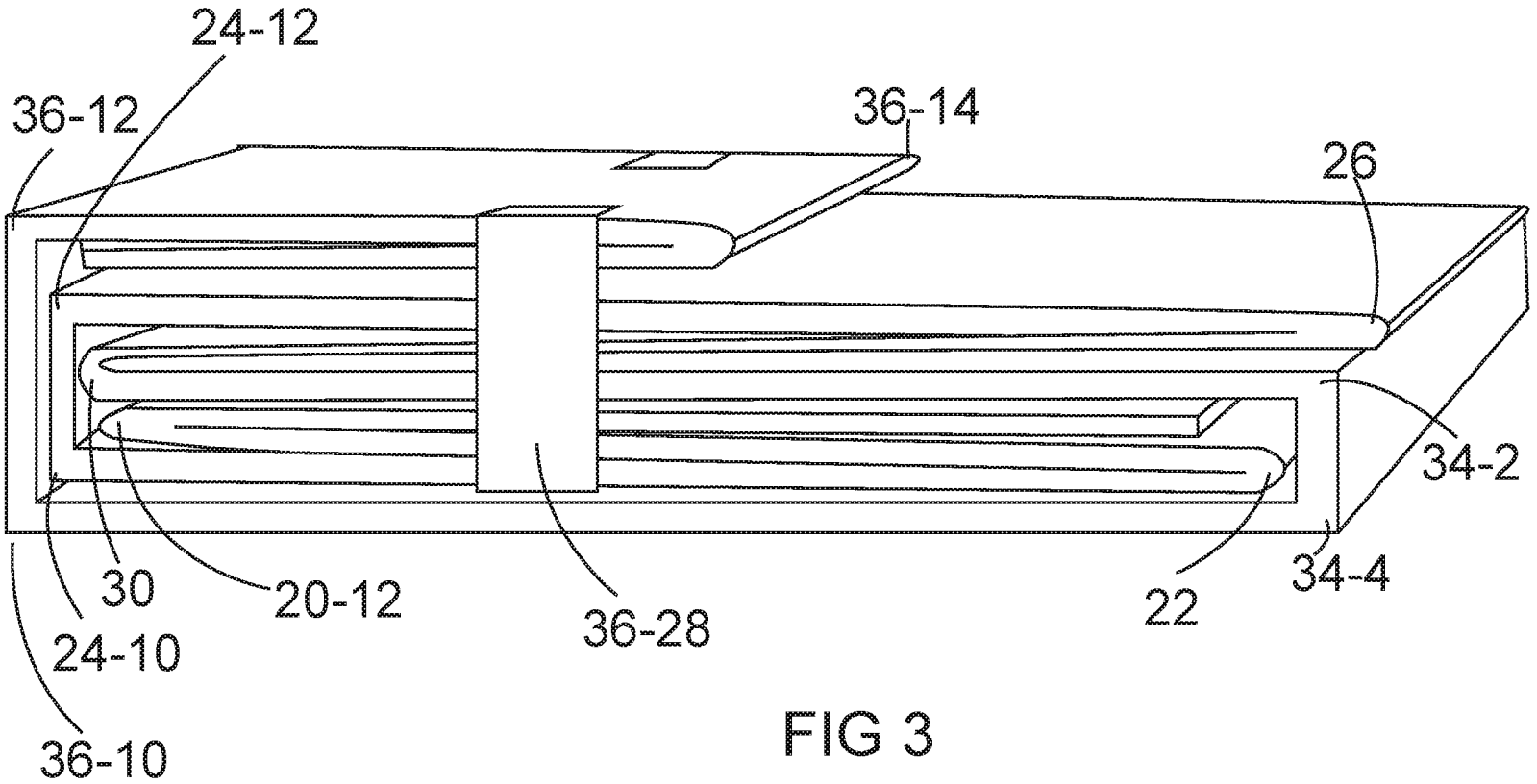
FIG. 3 is a perspective view of a completed representation of one embodiment of the portable surface for lounging or sleeping, in its folded for portability orientation.

FIGS. 1, 2, and 3—First Embodiment

Referring to FIGS. 1, 2, and 3, one embodiment of a portable surface for lounging or sleeping includes a lower backrest segment support assembly 20 which is comprised of three segments of flat, rectangular material. In one embodiment the segments are made of corrugated plastic. However, the segments can consist of any other material that can be repeatedly bent and straightened without fracturing such as polyethylene, vinyl, nylon, rubber, various laminated fibrous materials. Segments could also consist of sheets of rigid material such as wood or metal, joined by hinges. In one embodiment all of the segments of the device are portions of a single larger sheet of material separated by pre-worn creases. However, the segments could be made of multiple sheets of material attached pivotally to one another.

Two of the segments (segments 20-2 and 20-4) act as support members for the lower segment of the backrest, and are joined pivotally (or separated by a fold) 20-12 at one end. Segment 20-4 is joined pivotally (or separated by a fold) 20-10, to segment 20-6, which rests flat on the ground. A string or band 20-8 connects the first lower backrest segment support member 20-2 at its unattached end, to segment 20-6 and does not allow the fold 20-12 to open more than 90°. The first lower backrest segment support member 20-2 should lie at a near 45° angle with the ground, thus completing the lower backrest segment support assembly 20.

The lower backrest segment support assembly 20 attaches pivotally (or separated by a fold) 22 to the upper backrest segment support member 24-2. The upper backrest segment support member 24-2 attaches pivotally (or separated by a fold) 22 at one end to segment 20-6 and ascends at a near vertical angle. At the opposite end, the upper backrest segment support member 24-2 connects pivotally (or separated by a fold) 24-10, to the backrest 24, which is comprised of three segments of flat rectangular material, the first being a short segment 24-4. Segment 24-4 adds space between the upper backrest segment support member 24-2 and the upper backrest segment 24-6 so that the lower backrest segment support assembly 20, the backrest 24 and the seat 32 can fold up neatly between segments 24-2 and 24-6. On its opposite side segment 24-4 attaches pivotally (or separated by a fold) 24-12 to the upper backrest segment 24-6 (where the chair occupant's head will lie).

The upper backrest segment 24-6, attaches pivotally (or separated by a fold) 26 to the lower backrest segment 28, thus completing the backrest. The lower backrest segment 28 rests over the first lower backrest segment support member 20-2 of the lower backrest segment support assembly 20, and can meet at a variety of points, creating a variety of different back and neck angles. The lower backrest segment 28 is attached pivotally (or separated by a fold) 30 at its opposite end, to the seat 32 which is comprised of a flat rectangular sheet of material that rests on the ground (or any supporting surface on which the device is placed, for instance, the bed of a truck). The seat 32 is where the chair occupant's rear will sit. The seat 32 is attached pivotally (or separated by a fold) 34-2 to a short segment 34. Segment 34 adds space between segments 32 and 36-2 to allow the backrest 24, upper backrest segment support member 24-2 and structural back support assembly 20 to fold neatly between segments 36-2 and 36-8, for compact storage and portability. On its opposite side, segment 34 is attached pivotally (or separated by a fold) 34-4 to the leg support assembly 36.

The leg support assembly 36 is comprised of four segments of flat rectangular material. Segment 36-2 attaches pivotally (or separated by a fold) 34-4 to segment 34 at one end, and angles upward. On the opposite end segment 36-2 attaches pivotally (or separated by a fold) 36-10 to a short segment 36-4. The underside of the chair occupant's knee will rest on segment 36-4. On its opposite side segment 36-4 is attached pivotally (or separated by a fold) 36-12 to the first leg rest support member 36-6 which forms a near 90° angle with the ground at its opposite end and supports segment 36-4. At its opposite end, the first leg rest support member 36-6 attaches pivotally (or separated by a fold) 36-14 to the second leg rest support member 36-8 which forms a near 90° angle with the ground. The opposite end of the second leg rest support member 36-8 is not attached to anything, but rests in fold 36-10 giving extra support to segment 36-4 and distributing the weight of the legs over a larger area to reduce pressure and increase comfort. In the first leg rest support member 36-6 two slits are cut: a left slit 36-22 and a right slit 36-24. In segment 36-2 two slits are cut: a left slit 36-20 and a right slit 36-26. A strap 36-28 runs through slit 36-20, passes around the outside of the first leg rest support member 36-6, runs through slit 36-22, passes around the outside of the second leg rest support member 36-8, runs through slit 36-24, passes around the outside of the first leg rest support member 36-6, and runs through slit 36-26. The two ends of the strap are looped through two halves of a side-release buckle: the left 36-16 and the right 36-18. The strap 36-28 prevents the first and second leg rest support members 36-6 and 36-8 from sliding out when the weight of the chair occupants' legs rest on the leg support assembly 36, by securing them (36-6 and 36-8) to segment 36-2. The buckle halves 36-16 and 36-18 prevent the strap 36-28 from sliding out of slits 36-20 and 36-26 thereby keeping the strap 36-28 taught and the leg support assembly 36 in place.

In one embodiment of a portable surface for lounging or sleeping, the various segments are of such a proportion to each other that they can fold up (FIG. 2) into a small portable bundle (FIG. 3). In one embodiment the length of the various segments are as follows: 20-2: 8" 20-4: 4" 20-6: 6.5" 24-2: 11.5" 24-4: 1.5" 24-6: 11.5" 28: 11.5" 32: 11.5" 34: 1.0" 36-2: 12" 36-4: 2" 36-6: 7" 36-8: 6.5". These are by no means the only dimensions or proportions that will work and should not be construed as limitations on the scope.

Operation:

Referring to FIG. 1, operation of one embodiment of a portable surface for lounging or sleeping is as follows. To set up the chair for use, the lower backrest segment 28 can be rested on the first lower backrest segment support member 20-2. The angle of the backrest 24 can be adjusted by sliding the lower backrest segment support assembly 20 backwards or forwards. The leg support assembly 36 can be secured in place by pulling the ends of the strap 36-28 through the halves of the side-release buckle 36-16 and 36-18 until segments 36-6 and 36-8 are stable. The underside of the occupant's knee rests on segment 36-4.

FIG. 2 shows the routes of travel for the moveable components of one embodiment of a portable surface for lounging or sleeping. To fold the chair up for easier portability, the lower backrest segment support assembly 20 is folded into the backrest 24 by folding inward at fold 22 so that fold 20-12 nests inside fold 24-10. The lower backrest segment 28 is folded into the backrest 24 by folding inward at fold 26 so that fold 30 nests inside fold 24-12. The backrest 24 and its contents then fold into the leg support assembly 36 at fold 34-2 where the seat 32 protrudes from being folded within the backrest 24. The backrest 24 nests between the second leg rest support member 36-8 (which remains folded at fold 36-14) and segment 36-2. The strap 36-28 is then tightened by connecting the two side-release buckle halves 36-16 and 36-18, to secure the embodiment of a portable surface for lounging or sleeping, for convenient portability as shown in FIG. 3.

Figure 4:
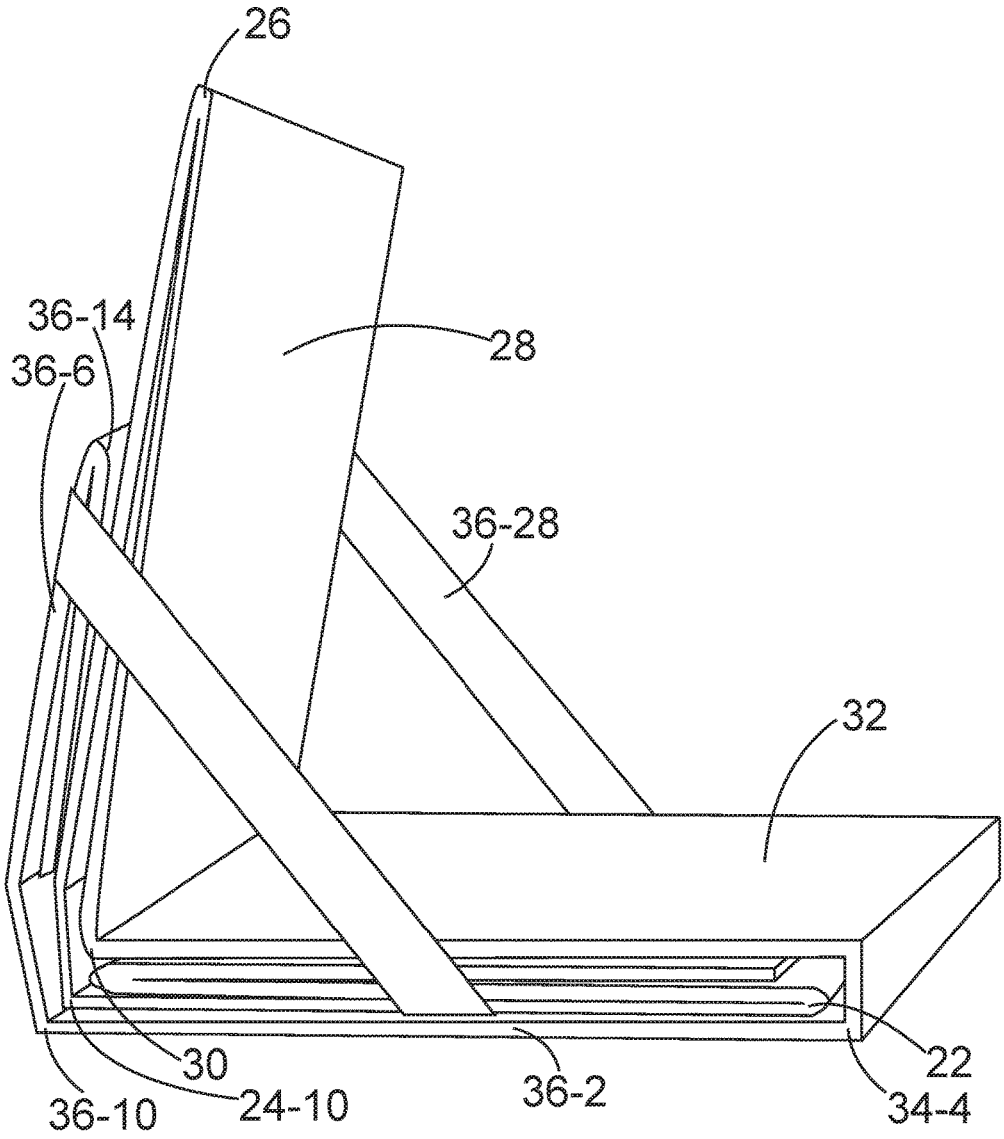
FIG. 4 is a perspective view of a completed representation of one embodiment of a portable surface for lounging or sleeping, in its stadium seat orientation.

Referring to FIGS. 1, 3 and 4, from the folded for portability orientation shown in FIG. 3, one embodiment of the portable surface for lounging or sleeping can be quickly converted to a stadium seat of the style placed atop a bleacher seat at a sporting event. When the side release buckle 36-16 and 36-18 is released (FIG. 1), the lower backrest segment 28 can be pivoted to form a 90° angle with the seat 32 at fold 30 (FIG. 4). The occupant can sit on the seat 32 and lean back on the lower backrest segment 28. Ultimately, the lower backrest segment 28, and the seat 32 are still nested between the first leg rest support member 36-6 and segment 36-2 in this orientation. The strap 36-28 is looped through both the first leg rest support member 36-6 and segment 36-2, and becomes taught when the occupant leans back against the lower backrest segment 28, securing it at a 90° angle with the seat 32 at fold 30.

Figure 5:
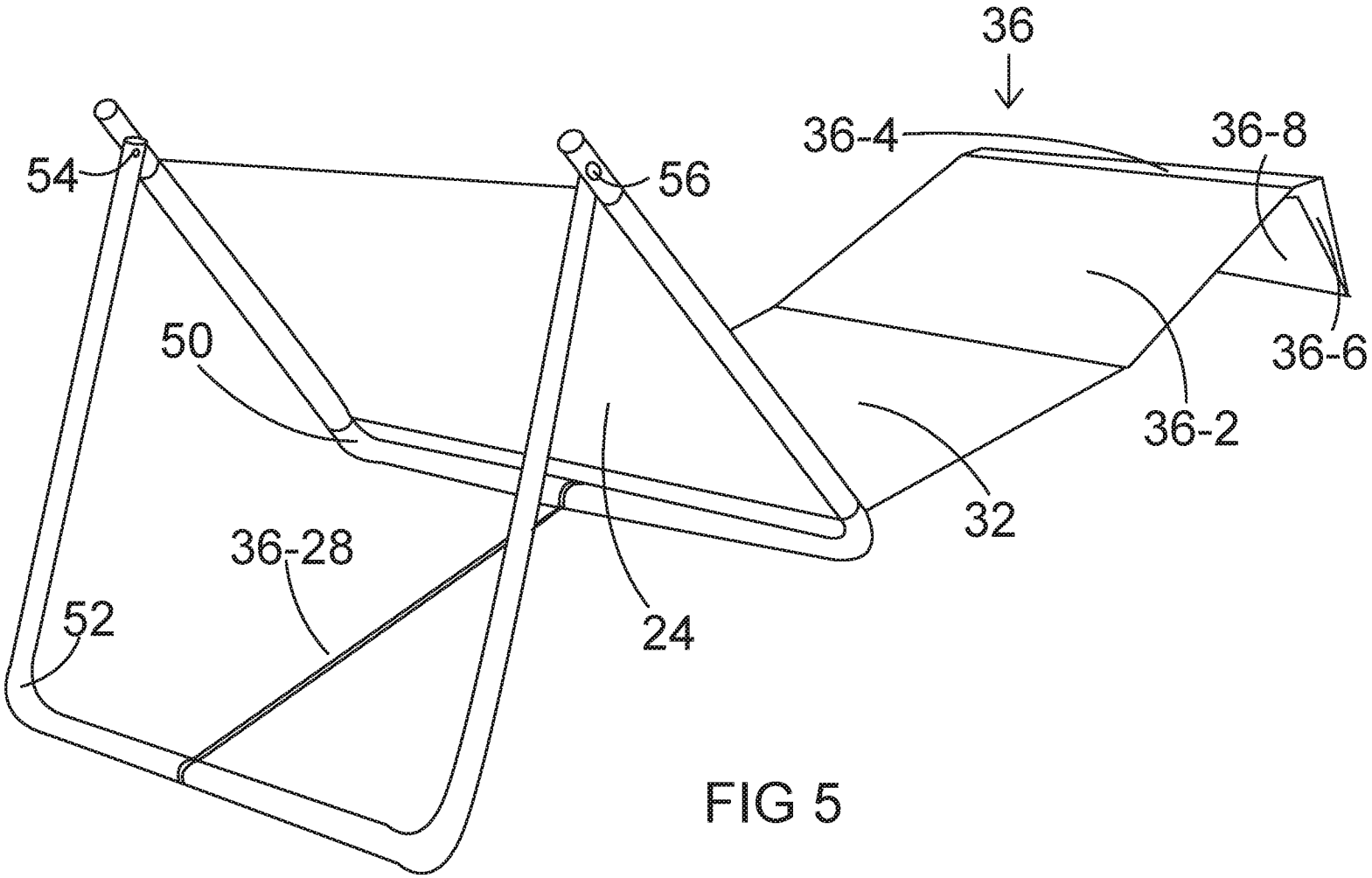
FIG. 5 is a perspective view of a completed representation of an alternate embodiment of a portable surface for lounging or sleeping.

FIG. 5—Additional Embodiment

An additional embodiment is shown in FIG. 5. In this embodiment the backrest 24 is attached to a tubular frame 50, which is supported by another tubular frame 52. The backrest frame 50 and backrest support 52 are attached pivotally at one end by a first and second pin (54 and 56). At the opposite end they are attached by a strap 36-28 which holds the backrest frame 50 and backrest 24 stable relative to the backrest support 52. The backrest 24 is attached pivotally (or separated by a fold) to the seat 32, which rests directly on the ground. The seat 32 is attached pivotally (or separated by a fold) to the leg support assembly 36.

Alternative Embodiments

While the above description contains many specificities, these should not be construed as limitations on the scope, but rather as an exemplification of one embodiment. Many other variations and modifications are possible. For example, the structural material from which the device is constructed could be any number of styles, shapes configurations. The material the chair is constructed of could be any number of materials such as plastic, wood, metal, rubber, webbing, rope, twine etc.

Additional alternative embodiments include: the size of any or all of the components could be increased or decreased. The angles of the components could be increased or decreased. The number of segments could be increased or decreased. The backrest could be secured to the structural back support assembly with an adhesive such as hook and loop, or any number of mechanisms or configurations. Padding could be added to any or all components. Armrests could be added. Extra straps for carrying the chair like a backpack could be added. Any number of mechanical, stylistic, ornamental, or other add-ons could be added to the apparatus.

CONCLUSION, RAMIFICATIONS, AND SCOPE

With respect to the above numerous possible alternative embodiments, it is obvious that numerous modifications, omissions, substitutions, arrangements, and changes could become obvious to those skilled in the art; therefore, the apparatus cannot be limited to the exact embodiment, description, configuration, construction or operation shown. The scope of the embodiment should be determined by the appended claims and their legal equivalents, rather than by the examples given.

Accordingly, the reader will see that the portable surface for lounging or sleeping can be used to lounge comfortably without excessive weight and bulk when carried. By employing a base that is not adapted, but placed directly on the ground, the present invention can be constructed cost efficiently, with low bulk and weight. The absence of a rigid frame makes it possible to fold the surface at many places in order to take up less space for transport and storage. Supporting the occupant's thighs at an elevated angle, relieves tension at the joints by allowing the legs to bend. This orientation of the legs obviates the need for a seat that is in any way adapted to rest off of the ground and makes for a more comfortable lounging position. The device is also versatile and can additionally be configured to support an occupant in an upright position in the manner of a stadium seat.

I claim:

1. A portable seat for lounging or sleeping, comprising:

(a) a sheet of material foldable between a use configuration and a collapsed configuration;

(b) wherein the sheet of material comprises a plurality of surfaces joined at a plurality of folds;

(c) wherein the plurality of surfaces includes a backrest surface configured to support an occupant's back in the use configuration, a leg rest surface configured to elevate an occupant's legs in the use configuration, and a seat surface disposed between the backrest surface and the leg rest surface and directly contacting a supporting surface in the use configuration;

(d) wherein the plurality of surfaces includes a first lower backrest segment support member joined by a first fold to a second lower backrest segment support member, the first lower backrest segment support member and the second lower backrest support member disposed directly under the backrest surface in the use configuration;

(e) wherein the plurality of surfaces includes a first leg rest support member joined by a second fold to a second leg rest support member, the second fold is configured to directly contact the supporting surface in the use configuration;

(f) wherein the backrest surface comprises an upper backrest segment and a lower backrest segment jointed at a third fold; and (g) wherein the portable seat is frameless.

2. The portable seat for lounging or sleeping of claim 1, further including at least one strap configured to retain the leg rest surface in position in the use configuration.

3. The portable seat for lounging or sleeping of claim 2, wherein the at least one strap extends through slits disposed in the sheet of material.

4. The portable seat for lounging or sleeping of claim 2, wherein the at least one strap is configured to maintain the sheet of material collapsed in the collapsed configuration.

5. The portable seat for lounging or sleeping of claim 1, wherein the sheet of material is configured for use as a stadium seat in the expanded configuration.

6. The portable seat for lounging or sleeping of claim 1, wherein the backrest surface and the leg rest surface are inclined in the use configuration, wherein the incline of the backrest surface and the leg rest surface is adjustable.

7. The portable seat for lounging or sleeping of claim 1, wherein the sheet of material is configured from a single sheet.

* * * * *